United States Patent [19]

Yu

[11] Patent Number: 4,779,907

[45] Date of Patent: Oct. 25, 1988

[54] SUITCASE LOCK

[75] Inventor: Wen-Chi Yu, Chang Hua, Taiwan

[73] Assignee: Tatie Industrial Co., Ltd., Chang Hua, Taiwan

[21] Appl. No.: 45,406

[22] Filed: May 4, 1987

Related U.S. Application Data

[63] Continuation-in-part of Ser. No. 815,052, Dec. 31, 1985, abandoned.

[51] Int. Cl.[4] ..... E05B 65/52

[52] U.S. Cl. ..... 292/33; 70/312; 292/333; 292/335; 292/DIG. 72

[58] Field of Search ..... 70/312; 292/DIG. 72, 292/335, 334, 252, 333, 33

[56] References Cited

U.S. PATENT DOCUMENTS

| | | | |
|---|---|---|---|
| 3,135,105 | 6/1964 | Brody | 292/33 |
| 4,263,794 | 4/1981 | Satliff | 70/312 |
| 4,366,685 | 1/1983 | Remington | 70/312 |
| 4,395,892 | 8/1983 | Remington | 70/312 |
| 4,416,126 | 11/1983 | Remington | 70/71 |
| 4,597,599 | 7/1986 | Bisbing | 292/DIG. 72 |
| 4,677,832 | 7/1987 | Remington | 70/312 |

*Primary Examiner*—Henry E. Raduazo

*Attorney, Agent, or Firm*—Cushman, Darby & Cushman

[57] ABSTRACT

A suitcase lock comprises a manually operable actuator mounted in a bowed handle of a suitcase to actuate a guiding means which incorporates a combination lock and which in turn moves a release plate. The release plate has two opposite ends connecting with two locking means which are unlocked upon moving the release plate. The guiding means is provided with a means that prevents the suitcase lock from unlocking when the suitcase is not in a correct position.

11 Claims, 9 Drawing Sheets

SUITCASE LOCK

This application is a continuation-in-part application of U.S. patent application No. 815,052 filed on Dec. 31, 1985, which is now abandoned.

BACKGROUND OF THE INVENTION

This invention relates to a suitcase lock, and particularly to a suitcase lock mounted inside a suitcase and operable through a press button mounted in a bowed handle of the suitcase.

SUMMARY OF THE INVENTION

An object of the invention is to provide a novel suitcase lock that can be operated conveniently by depressing a button near a handle of a suitcase. Another object of the invention is to provide a novel suitcase lock that can be prevented from being unlocked when the suitcase is upside down.

The present invention provides a suitcase lock comprising: two latch means mounted in a top cover of the suitcase; a housing mounted adjacent to a front wall of a lower case of the suitcase; two locking means mounted in two end portions of the housing, each of the locking means having an engaging plate with an engaging slot for engaging with each of the latch means, the plate being movable between a releasing position and a locking position; a compression member disposed below the engaging plate which is depressed by the latch when the latch extends through the engaging slot and which springs the latch upward when the latch is released from the engaging slot; means connected to the engaging plate and the compression member for moving the engaging plate to the locking position when the compression member is depressed; means for releasing the latches from the locking means including an elongated release plate which is disposed in the housing between the locking means, the release plate being movable in a first direction to actuate by its two ends the engaging plates of the locking means to the releasing position and in a second direction to return to its original position; means for guiding the release plate including a body disposed adjacent to the elongated plate, an elongate guide means mounted movably in the body and capable of engaging with the release plate to move it in the first direction; and means for actuating the guiding means mounted in the bowed handle of the suitcase, including a cam member engaging with the elongated guide means, an actuating member engaging with the cam member, and a press button engaging with the actuating member and exposed in part from the bowed handle, the actuating member actuating the rotary cam member to move the elongated guide means when the press button is depressed.

The present exemplary preferred embodiment will be described in detail with reference to the following drawings, in which:

DETAILED DESCRIPTION OF THE PREFERRED EMBODIMENT

Figure 1:
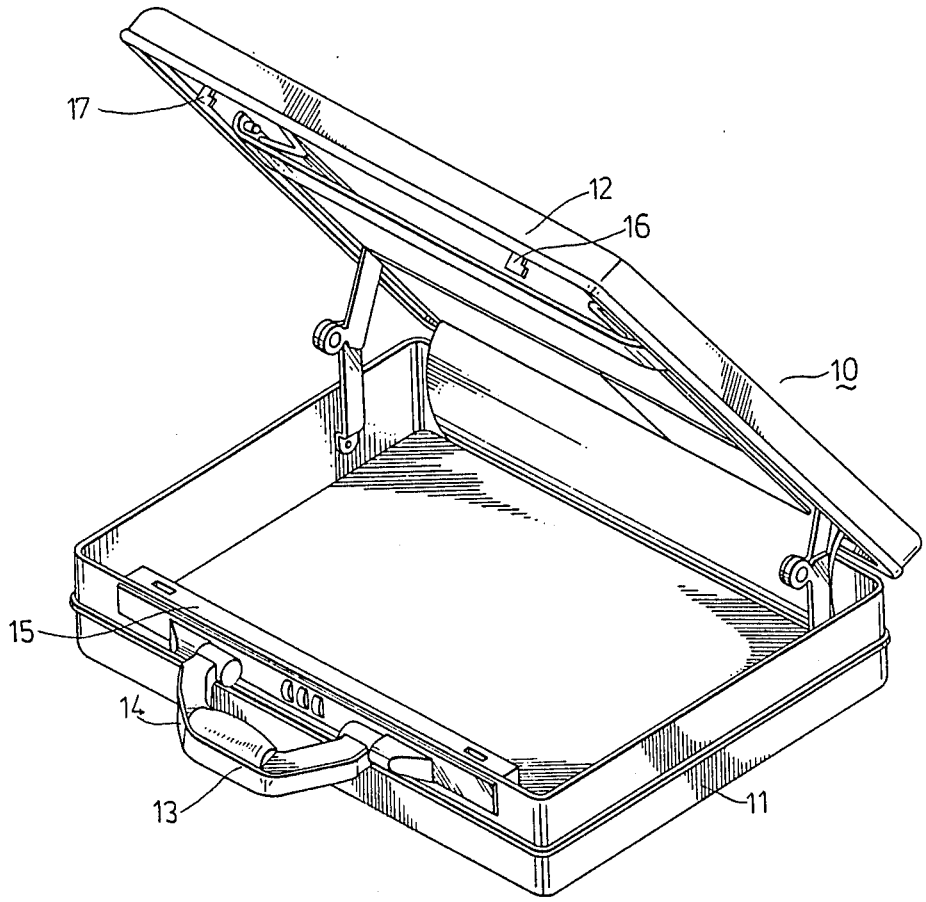
FIG. 1 is a perspective view of a suitcase incorporating a lock according to the invention.
Figure 2:
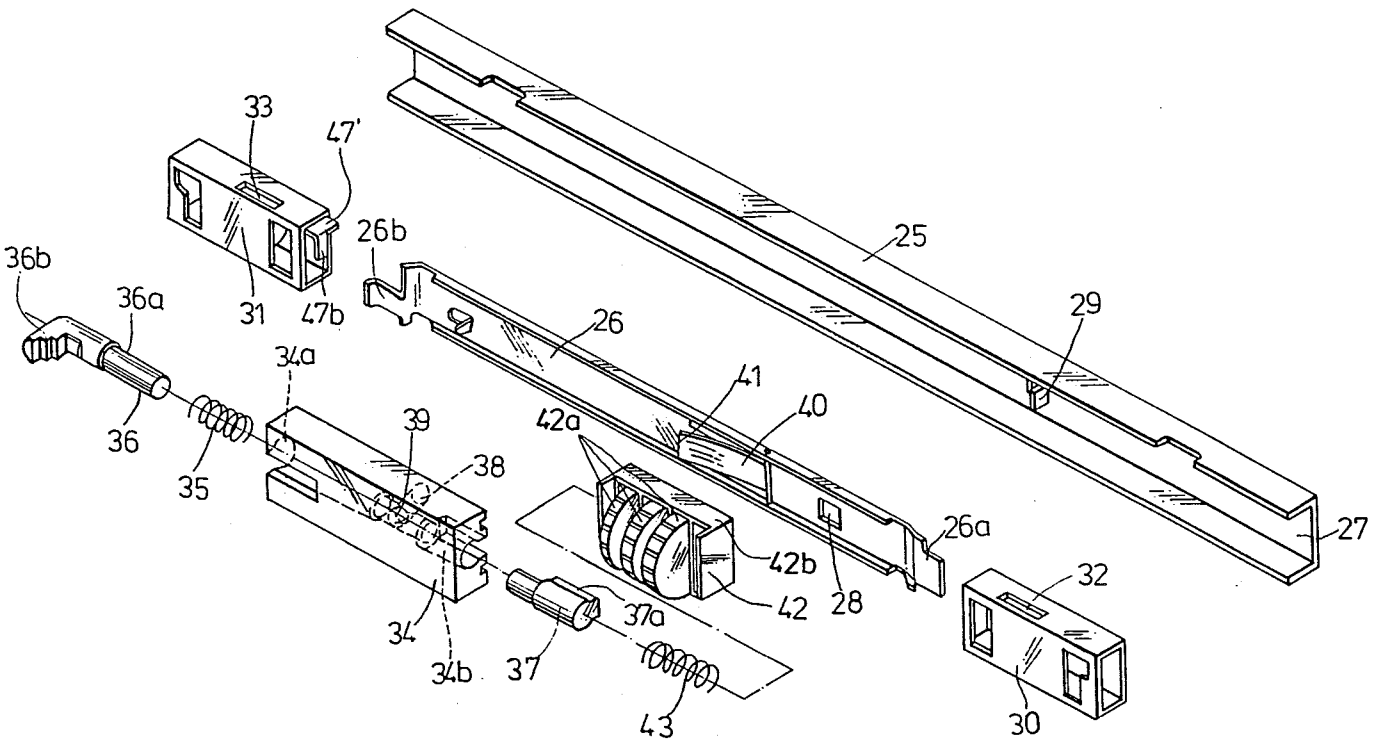
FIG. 2 is an exploded view of a portion of a lock of a first embodiment.
Figure 3:
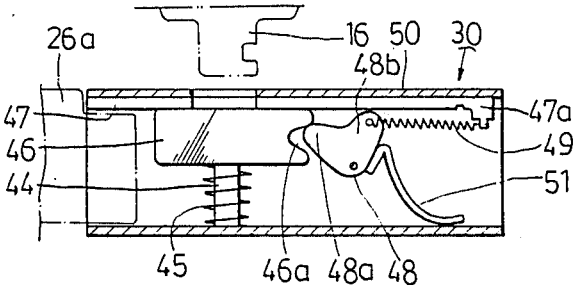
FIGS. 3, 4, and 5 are sectional views of the locking means of the lock of FIG. 2.

Referring to FIG. 1, there is shown a suitcase constituted of a lower case 11 and an upper cover 12. To the lower case 11 is attached a lock assembly 15 and a bowed handle 13 with a press button 14 by which the lock assembly 15 can be operated. To the upper cover 12 are attached two latches 16 and 17 which will engage with the lock assembly 15 to lock the suitcase.

As shown in FIGS. 2, 3, 4 and 5, the lock assembly 15 includes a housing channel member 25 mounted in the lower case 11. At the end portions of the channel 25 are mounted two locking means 30 and 31 for engaging with the latches 16 and 17 respectively. The locking means 30 includes a housing 50 mounted in the housing channel 25. An engaging plate 47 is slideably mounted on the inner side of the top wall of the housing 50 and provided with an engaging slot 52 which can be aligned with a top opening 32 and which can engage with the latch 16.

Figure 4:
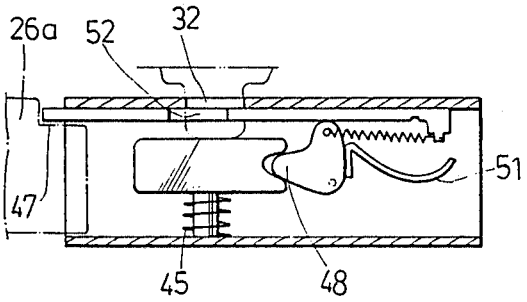

Below the engaging plate 47 is a compression block 46 which is attached to the top of a pin 44 mounted in the housing 50. A spring 45 is sleeved on the pin 44 and biases the compression block 46 upward to abut against the engaging plate 47. The block 46 has a notch **46*a* for engaging with a crank member 48. The crank member 48 is mounted pivotally in the housing 50 and has an arm 48*a* engaging with the notch 46*a* of the block 46 and an arm 48*b* connected to a spring 49 which is in turn connected to a flanged end 47*a* of the engaging plate 47. When the latch 16 enters the housing 50, it depresses the compression block 46 as shown in FIG. 4, and the block 46 causes the crank member 48 to turn counter-clockwise, thereby moving the engaging plate 47 to the left or to the locking position. As the engaging plate 47 is moved to the left, the engaging slot 52 engages with or catches the latch 16 so that the suitcase is locked, as shown in FIG. 4. The engaging plate 47 can release the latch 16** when it is moved to the right, i.e., the releasing position.

Figure 5:
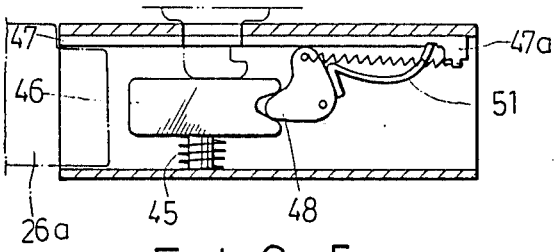

The crank member 48 is provided with a restraining member 51 in order to prevent the engaging plate 47 from moving to its locked position after it is moved to the right but the latch 16 is not sprung upward due to a load placed on the top cover of the suitcase. To keep the engaging plate 47 in the releasing position until the load on the top cover is removed, the restraining member 51 is connected to the arm **48*b* of the crank 48 so as to prevent the engaging plate 47 from moving to the locking position. The restraining member 51 is in the form of a curved strip which is affixed to the arm 48*b* of the crank 48 and has a free end capable of engaging with the flanged end 47***a* of the engaging plate 47. The free end of the strip 51 engages with the flanged end 47*a* of the engaging plate 47 to prevent it from moving to the left when the compression block 46 is depressed further by the latch 16 due to the weight of the load on the top cover, as shown in FIG. 5.

The locking means 31 also includes a housing which is similar to the housing 50 of the locking means and has a top opening 33 accessible by the latch 17. The construction of the locking means 31 is substantially the same as that of the locking means 30 except for a slight difference which will be described hereinafter.

Referring again to FIG. 2, there is an elongated release plate 26 slideably mounted in the channel 25 between two locking means 30 and 31. The release plate 26 has an oblong aperture 28 through which passes a protrusion 29 projecting from the back side 27 of the channel 25. The release plate 26 is movable limitedly relative to the channel housing 25 because of the aperture 28 and the protrusion 29. The ends of the release plate 26 will move the enagaging plates 47 of the locking means 30 and 31 to the releasing position.

The difference between the locking means 30 and 31 is that the engaging plate 47 of the locking means 30 is pushed by the release plate 26 for releasing the latch 16 whereas an engaging plate 47' of the locking means 31 is pulled by the release plate 26 to release the latch 17. The release plate has an end 26*a* to push the engaging plate 47 of the locking means 30 and has another end 26*b* to pull the engaging plate 47' of the locking means 31. The engaging plate 47' of the locking means 31 is provided with a hook 47*b* extending downwardly so as to be pulled by the end 26*b* of the release plate 47.

A means for guiding the release plate 26 is mounted in the housing channel 25 adjacent to the front side of the release plate 26. This means includes a body 34 mounted in the housing channel 25 and having two longitudinal cylindrical bores 34*a* and 34*b* receiving two guide members 36 and 37 respectively, and a transverse cylindrical bore 38 receiving a ball piece 39. The transverse bore 38 is communicated with the longitudinal bores 34*a* and 34*b* and slants downward from one side to the other side. Adjacent to the body 34 is a combination lock 42.

When the suitcase 10 is in a correct position, that is to say, when the upper cover 12 is above the lower case 11, the ball piece 39 is at the lowest side of the transverse bore 38 between the bores 34*a* and 34*b* so that it contacts with the adjacent ends of the guide members 36 and 37. The guide member 36 is biased outward by a spring 35, which is sleeved on its contracted inner portion 36*a*, and has a projection 36*b* extending outward from the body 34. The guide member 37 is biased inward by a spring 43, which is disposed between the guide member 37 and the combination lock 42, and has a projection 37*a* extending outward from the body 34. The projection 37*a* of the guide member 37 is in contact with the end 41 of a spring plate 40 projecting from the release plate 26. The release plate 26 can be moved by moving the guide members 36 and 37 so as to move the engaging plates 47 of the locking means 30 and 31 to a releasing position.

It can be noted that the guide member 36 can move the guide member 37 only when the ball piece 39 is in contact with the ends of the guide members 36 and 37, that is to say, the guide member 36 moves the guide member 37 only when the suitcase 10 is in the correct position. If the suitcase 10 is reversed, the ball piece 39 will roll to the other side of the slanted transverse bore 38, leaving a space between the ends of the guide members 36 and 37. Therefore, when the suitcase is reversed, the locking means 30 and 31 can not release the latches 16 and 17 by moving the guide member 36.

The combination lock 42 has a known construction and includes three dial wheel assemblies 42*a*, and a means (not shown) which can extend out of or retract into a housing 42*b* of the lock 42 by the operation of the dial wheel assemblies 42*a*. This means will depress the spring plate 40 when it is in an extending position so that the spring plate 40 is prevented from engaging with the guide member 37. Thus, the release plate 26 can not be moved by, the guide member 37 when the dial wheels are not dialed to a proper combination.

Figure 6:
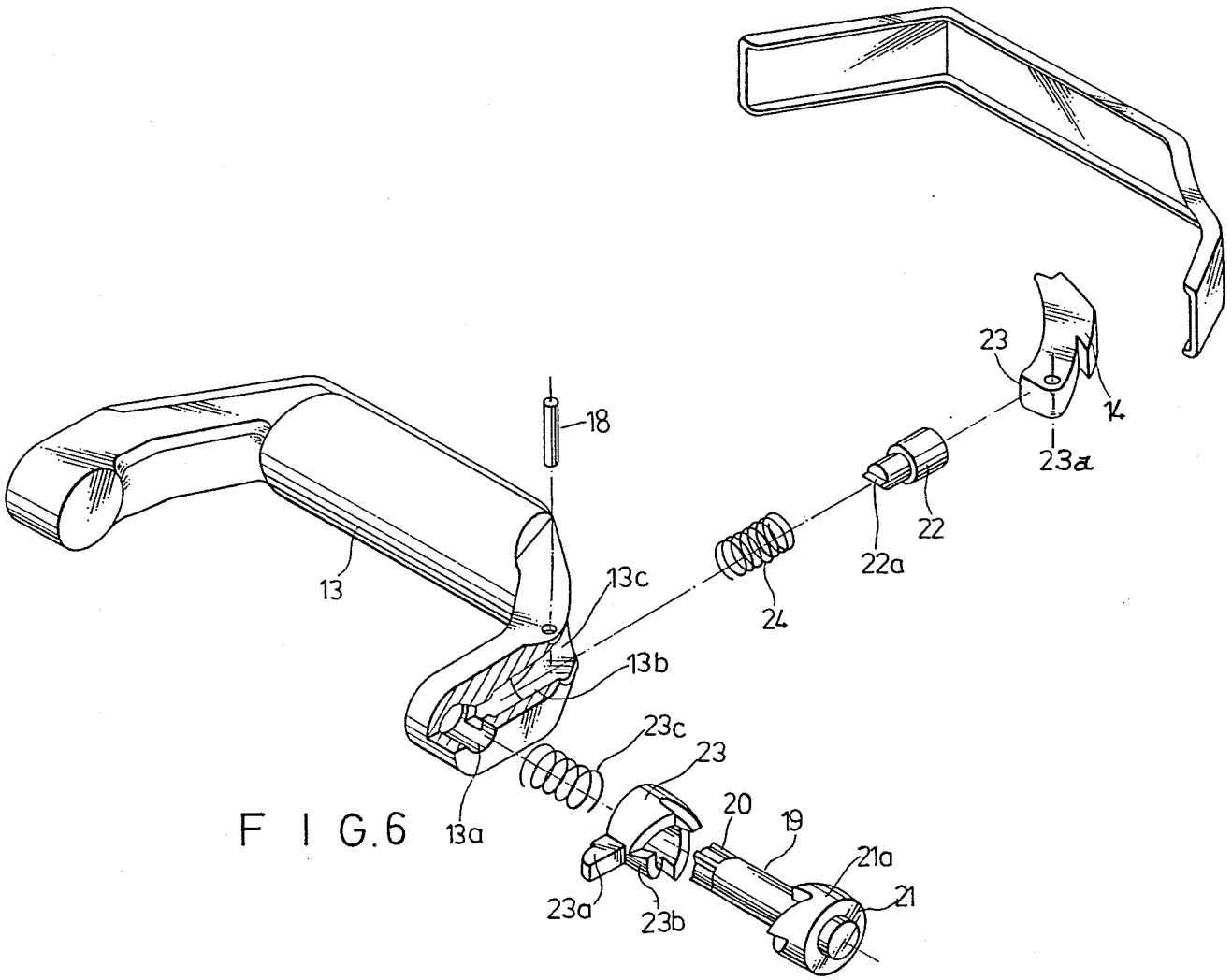
FIG. 6 is an exploded view of an actuating means of the lock of FIG. 2.
Figure 8:
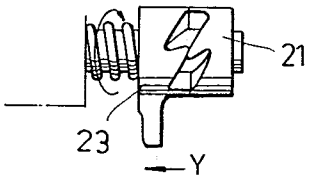
FIGS. 7 and 8 are elevation views of a portion of the actuating means of FIG. 6.
Figure 7:
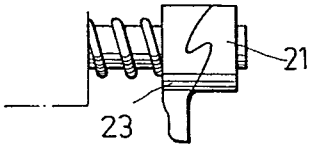
Figure 9:
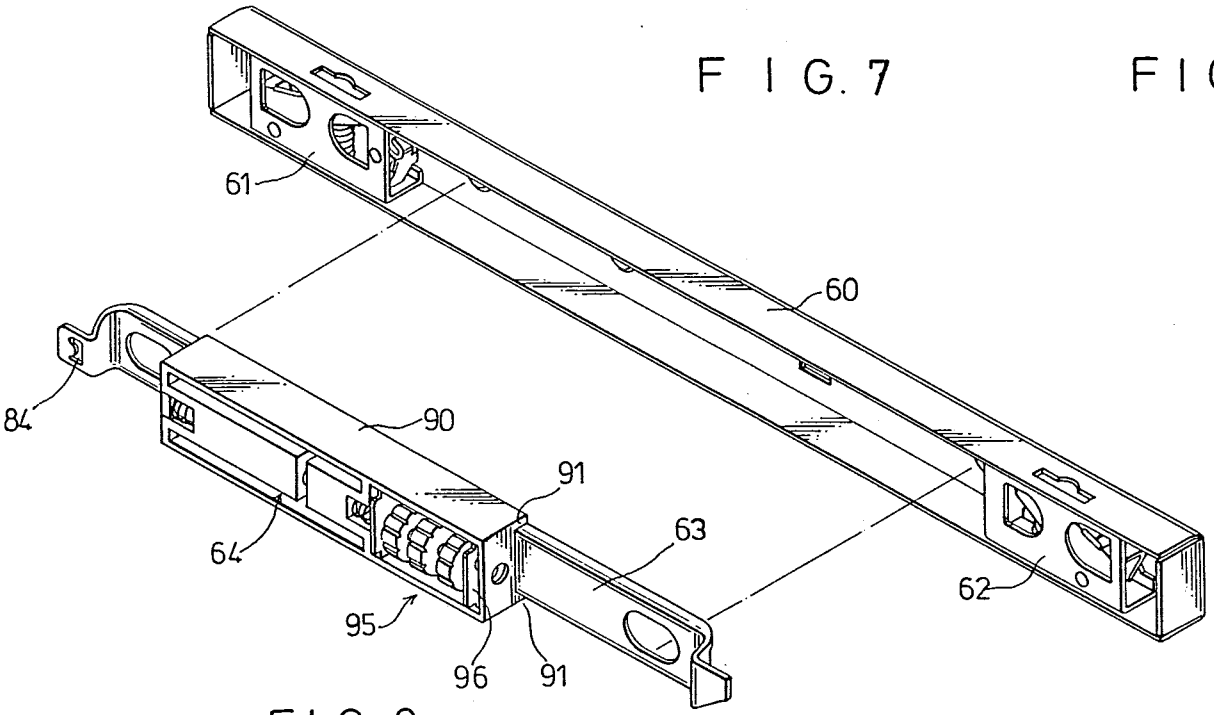
FIG. 9 is an exploded view of a second embodiment.

Referring to FIGS. 6, 7 and 8, in combination with FIG. 1, an actuating mechanism is provided in the bowed handle 13 of the suitcase 10 to actuate the guide member 36. The mechanism includes a rotary cam member having a circular head 21 with camming teeth 21*a* extending axially and a cylindrical stem 19 with axial ridges 20 on the periphery of its end portion. The stem 19 is received rotatably in a recess 13*a* of the handle 13. A stepped cylindrical actuator 22 which is loaded with a spring 24 is received movably in a recess 13*b* of the handle 13. The cylindrical actuator 22 has an engaging projection 22*a* to engage with one of the axial ridges 20 of the stem 19. The push button 14 is pivoted with a pin 18 to the handle 13 in a recess 13*c* and contacts with the cylindrical actuator 22 with its end 23. The spring 24 biases the cylindrical actuator 22 to a direction that pushes the button 14 to extend outward in part from the handle 13. When the button 14 is depressed, it turns about the pivot 23*a* and the end 23 thereof pushes the cylindrical actuator 22 so that the projections 22*a* moves one of the ridges 20 of the stem 19, thereby rotating the cam head 21. Around the stem 19 is disposed a sleeve 23 and a helical spring 23*c*. The sleeve 23 is provided with inclined teeth 23*b* extending axially at one end thereof and meshing with the camming teeth 21*a* of the cam head 21, and a radial lug 23*a* extending through the wall of the suitcase to engage with the projection 36*b* of the guide member 36. When the press button 14 is in its normal position, the teeth 23*b* of the sleeve 23 engage with the camming teeth 21*a* of the cam head 21 by the biasing action of the spring 23*c*, as shown in FIG. 7. When the press button 14 is depressed, the cam head 21 is rotated so that it cams the sleeve 23 to move in a direction as indicated by an arrow Y, as shown in FIG. 8. In this situation, the lug 23*a* moves the guide member 36, which in turn moves the guide member 37 thereby moving the release plate 26. As the release plate 26 is moved, the locking means 30 and 31 release the latches 16 and 17.

Referring to FIGS. 9 through 19, a second preferred embodiment of the present invention is shown, including a housing channel member 60 to be mounted in a suitcase. In the housing channel member 60 are mounted two locking means 61 and 62, an elongated release plate 63 and a guiding means 64.

Figure 11:
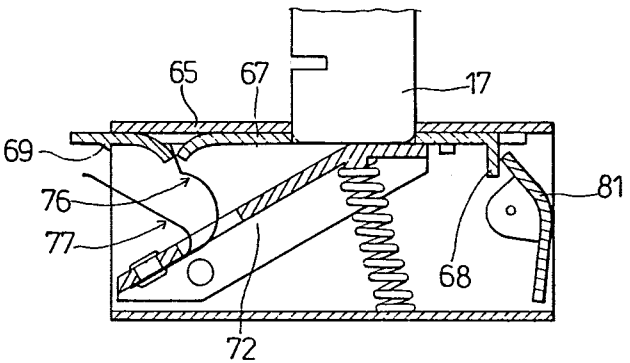
FIG. 11 is sectional view of the locking means of FIG. 10.
Figure 10:
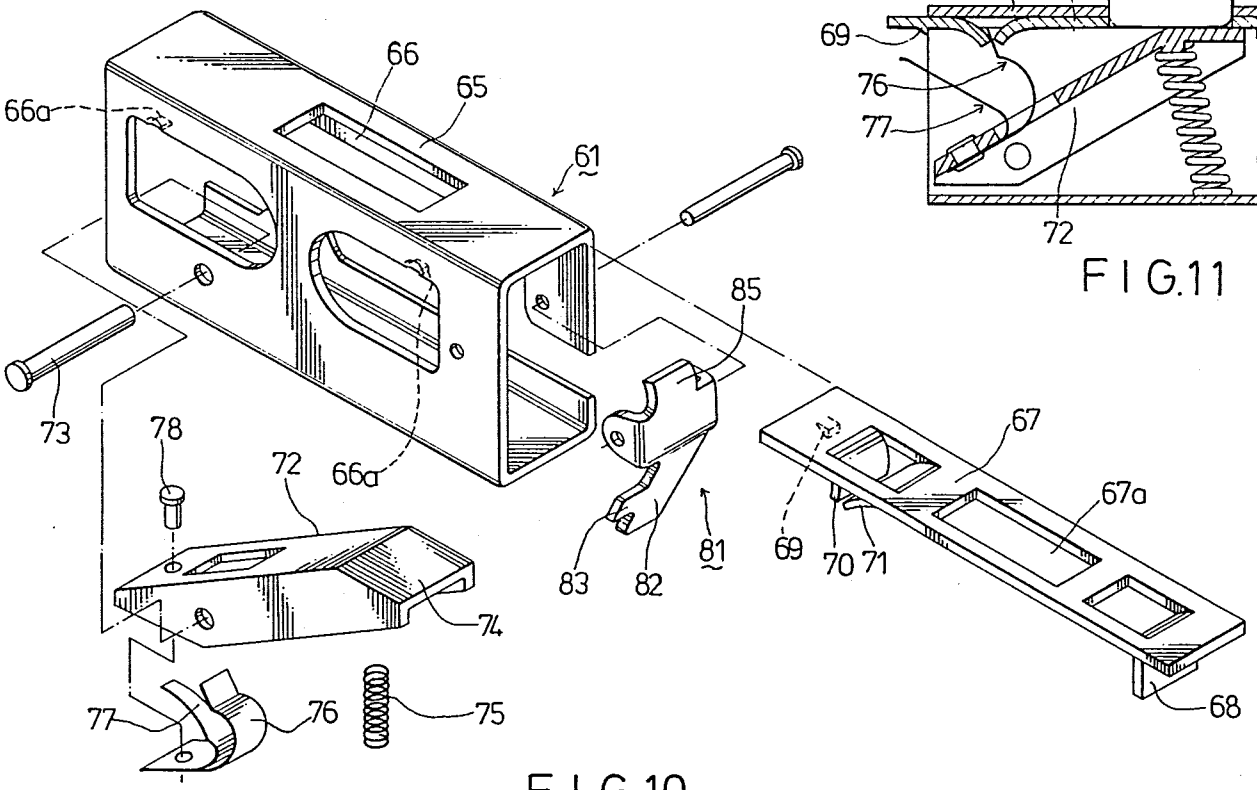
FIG. 10 is an exploded view of a locking means of the second embodiment.

As is better shown in FIGS. 10 and 11, the locking means 61 includes a housing 65 whose top is provided with a top opening 66. An engaging plate 67 is slideably mounted on the top side of the housing 65 by means of four guide pieces 66*a* disposed at the top side of the housing 65. The engaging plate 67 has an engaging slot 67*a* to engage with the latch 17, a downward projection 68, a boss 69 and two clamp lips 70 and 71. A compression member 72 is pivoted at one of its ends in the housing 65 by means of a pivot 73. Another end portion 74 of the compression member 72 is biased upward by a spring 75 which is connected to the lower side of the housing 65. Two curved spring plates 76 and 77 are fixed to the compression member 72 by means of a rivet 78. The curved spring plates 76 and 77 extend upward separately from the compression member 72. The end of the spring plate 76 is clamped by the clamp lips 70 and 71, and the end of the plate 77 is kept free. The curved spring plates 76 and 77 can be either of one piece or separate pieces. The spring plate 76 is used to move the engaging plate 67 to the locking position when the compression member is depressed, and the curved plate 77 is used to restrain the engaging plate 67 to move to the locking position after the engaging plate 67 releases the latch. A release crank 81 is pivoted in the housing 65, having an arm 82 with a projection 83 extending into a hole 84 of the release plate 63 and another arm 85 engaging with the projection 68 of the engaging plate 67.

Figure 12:
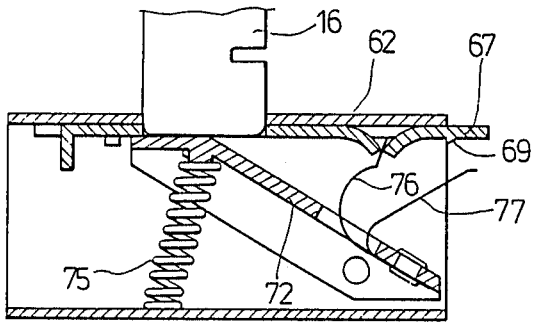
FIGS. 12, 13 and 14 are sectional views of another locking means of the second embodiment.
Figure 13:
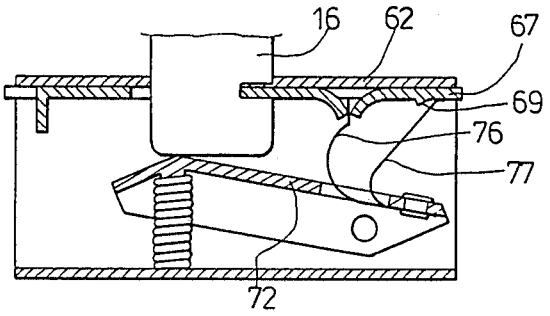
Figure 14:
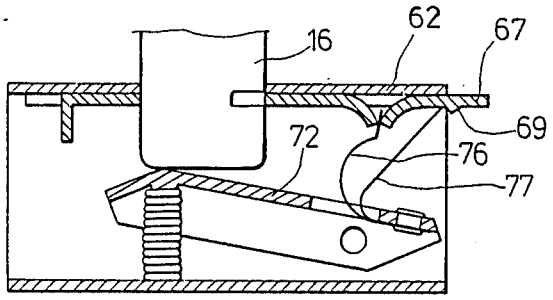

Referring now to FIGS. 12, 13 and 14, the construction of the locking means 62 is substantially similar to that of the locking means 61 except that the locking means 62 has no release crank 81 and the engaging plate of the locking means 62 is pushed directly by the release plate 63.

When the release plate 63 is moved to the right, the release plate pushes the engaging plate 67 of the locking means 61 to the left through the crank 81 and pushes directly the engaging plate 67 of the locking means 62 to the right, thereby releasing the latches 16 and 17.

The locking means 61 and 62 provide an advantage which can be appreciated by the following description. When there is a load on the top cover 12 of the suitcase, the latch 17 depresses the compression member 67 to an additional lower lever at the same instant that the latch 17 disengages from the engaging slot 67*a* of the engaging plate 67, as can be seen in FIG. 14. The compression member 72 causes the free end of the curved pate 77 to engage with the boss 69 of the engaging plate 67, thus preventing the engaging plate from moving to the left. The plate 77 holds the engaging plate 67 in a releasing position until the load on the top cover of the suitcase is removed.

Figure 15:
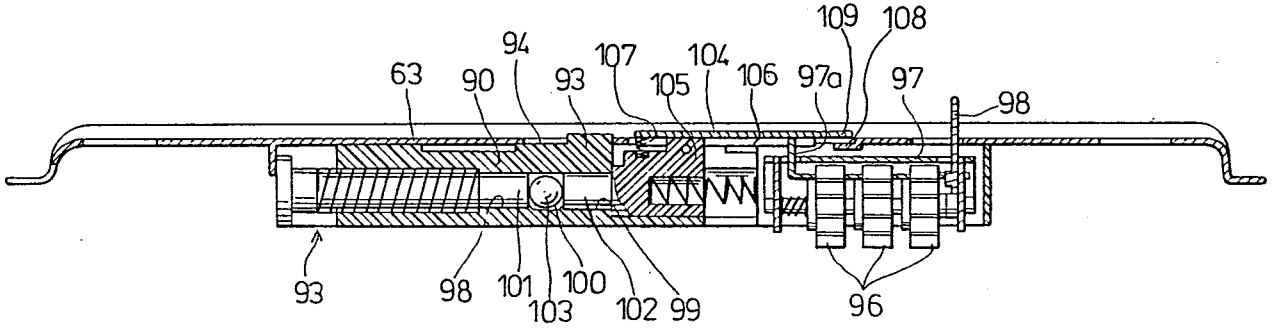
FIGS. 15 and 16 are sectional views of the guiding means of the second embodiment.
Figure 16:
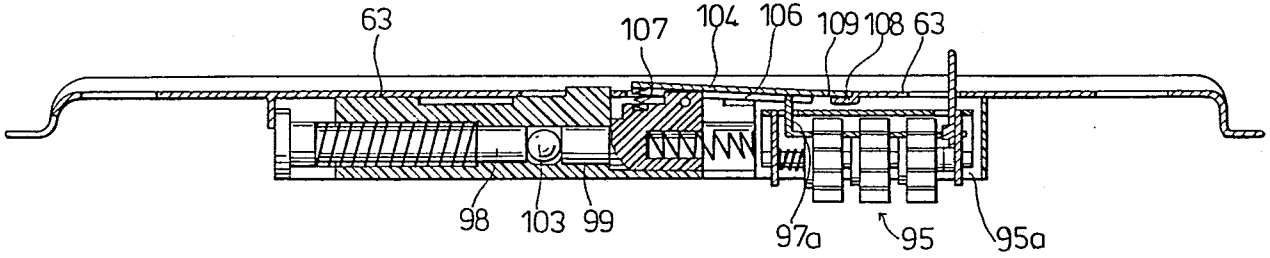

Referring to FIGS. 15 and 16, the release plate 63 is received slidably between two edge flanges 91 at the back side of a housing body 90 of the guiding means 64. A boss 93 of the body 90 extends into an opening 94 of the release plate 63 so that the release plate 63 moves within a limited distance relative to the body 90.

A combination lock 95 is mounted in a cavity 95*a* of the housing body 90 and has a construction which is known in the prior art. The combination lock 95 includes three dial wheel assemblies 96, a bolt 97 controlled by the dial wheel assemblies 96, and a shifting plate 98 which can be operated manually to set a desired combination of numerals of the dial wheel assemblies 96. The bolt 97 has a projection 97*a* which can be moved between an extending position and a retracted position.

The housing body 90 further includes two bores 98 and 99 which are aligned and spaced apart axially, and a transverse bore 100 between two bores 98 and 99. As in the case of the first embodiment, the bores 98 and 99 receive two spring loaded guide members 101 and 102 respectively and the transverse bore 100 receives a ball 103. The function and operation of the guide members 101 and 102, and the ball 103 are the same as that of the guide members 36 and 37 and the ball 39 of the first embodiment. A dog 104 in the form of a plate is disposed at the exterior of the body 90 and fulcrummed at a projecting portion 105 of the guide member 102. The dog 104 can be moved longitudinally by the guide member 102 within an opening 106 of the release plate 63. One end of the dog 104 is biased by a spring 107 so that another end 109 thereof engages in a punched recess 108 of the release plate 63. The end 109 will disengage from the relese plate 63 when it is pushed by the projection 97*a* of the bolt 97 of the combination lock 95 when the lock 95 is not in a proper combination, i.e., the projection 97*a* is in the extending position. As the end 109 disengages, the release plate 62 can not be moved by the guiding means 64, that is to say, the locking means 61 and 62 can not be unlocked.

Figure 17:
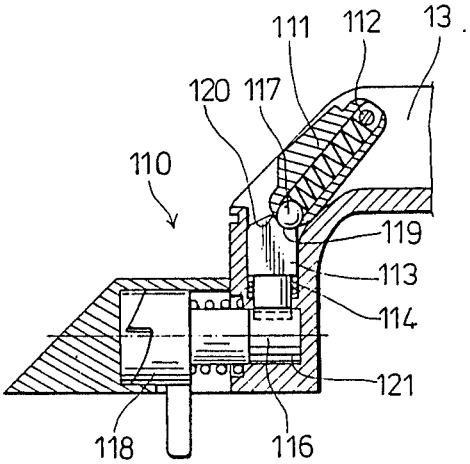
FIG. 17 is a sectional view of an actuating means of the second embodiment.
Figure 18:
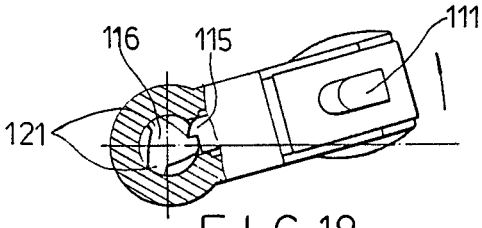
FIGS. 18 and 19 show schematically the operation of the actuating means of FIG. 17.
Figure 19:
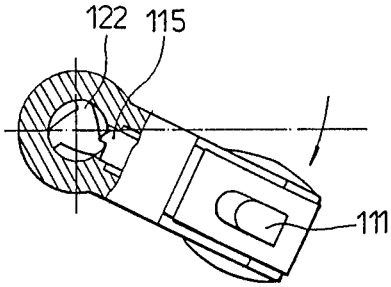

An actuating means 110 is also provided in this embodiment as in the first embodiment. As shown in FIGS. 17, 18, and 19, the actuating means 110 is substantially similar in construction to that of the actuating means of the first embodiment. It includes a press button 111 pivoted at 112 in the bowed handle 13 and having a retractable ball 117 projecting therefrom, a stepped cylindrical actuator 113 loaded with a spring 114 and having a projection 115, a rotary cam member 116 and a sleeve 118.

The cylindrical actuator 113 is substantially similar to the actuator 22 of the first embodiment except that a groove 119 and an edge 120 are provided at the top of the actutor 113. The rotary cam 116 differs from the rotary cam 21 in that three lobes 121 are disposed on the periphery of the stem portion of the cam 116. The construction of the sleeve 118 is identical to that of the sleeve 23. Before the press button 111 is depressed, the ball 117 is above the edge 120 of the actuator 113. When the button 111 is depressed by a pressure, the ball 117 passes the edge 120 and engages in the groove 119 of the actuator 113, thereby preventing the button 111 from moving upward by the action of the spring 114 upon removal of the pressure. The actuator 113 depressed thereby will actuate the rotary cam 116 by means of its projection 115.

In operation, the handle 13 is first turned upward and then the button 111 is depressed so as to place the projection 115 in a position engaging with one of the lobes 121 of the rotary cam 116, as shown in FIG. 18. Thereafter, the handle 13 is turned downward to rotate the rotary cam 116, as shown in FIG. 19, thereby camming the sleeve 118 and actuating the guide member 98. In the case in which the combination lock 95 is set to a proper combination in which the bolt projection 97*a* thereof is retracted, the guide member 99 will move the release plate 63 to unlock the locking means 61 and 62. After unlocking the locking means 61 and 62, the button 111 can be pushed upward to its original position from the position of FIG. 19 by turning the handle 13 upward. As such, the projection 115 of the actuator 113 moves to and passes over the round edge 122 of the lobe 121 above it and is thereby pushed by the round edge 122, causing the ball 117 of the button 111 to disengage from the groove 119 of the actuator 113.

What I claim is:

1. A lock for a suitcase having a top cover and a lower case with a bowed handle attached to a front wall of the lower case, comprising:

two latch means mounted in the top cover;

an elongated housing mounted adjacent to the inner side of the front wall of the lower case;

two locking means mounted in two end portions of the housing, respectively, each of said locking means having an engaging plate with an engaging slot for engaging with each of said latch means, said plate being movable between a releasing position and a locking position, a compression member disposed below each of said engaging plates, each of said compression members being depressed by said latch when said latch extends through said engaging slot and springing said latch upward when said latch is released from said engaging slot, and means associated with each of said engaging plates and said compression members for moving said engaging plate to the locking position when said compression member is depressed;

means for releasing said latches from said two locking means including an elongated release plate which is disposed in said housing between said two locking means and has two opposite ends engaging with said engaging plates of said locking means, said release plate being movable in a first direction to actuate said engaging plates to the releasing position and in a second direction to return to its original position;

means for guiding said release plate including a body disposed adjacent to said elongated plate and an elongated guide means mounted movably in said body and engaging with said release plate to move it in said first direction; and means for actuating said guiding means, said actuating means mounted in said bowed handle of said suitcase and including a rotary cam member engaging with said elongated guide means, and a manually operated actuating member engaging with said rotary cam member, said actuating member actuating said cam member to move said elongated guide means.

2. A lock as claimed in claim 1, in which each of said compression members includes a spring loaded block mounted in a housing of each of said locking means and normally biased toward said engaging plate, wherein said moving means of said locking means includes a pivoted crank member having two arms inclined from one another, one of said arms being connected to said spring loaded block, and a spring interconnecting the other one of said arms and said engaging plate, said block turning said crank member to move said engaging plate to the locking position when said block is depressed by said latch to a lower level.

3. A lock as claimed in claim 1, in which said compression member has one end pivoted in said housing and another end biased upward toward said engaging plate, and said engaging plate includes two clamping lips projecting downward, wherein said moving means of said locking means includes a first curved spring plate having one end connected to said compression member and another end extending upward and being clamped by said clamping lips.

4. A lock as claimed in claim 3, in which said engaging plate further includes an engaging boss at its bottom side, wherein said moving means of said locking means further includes a second curved spring plate which has a first end fixed to said one end of said first curved spring plate and said compression member near said pivoted end of said compression member and a second end being capable of engaging with said engaging boss of said engaging plate to prevent said engaging plate from moving to the locking position.

5. A lock as claimed in claim 1, in which said body of said guiding means includes two longitudinal bores which are aligned with and spaced apart from one another, and a transverse bore having a first end and a second end and being slanted downward from said first end to said second end, said second end of said transverse bore disposed between and communicated with said longitudinal bores, wherein said elongated guide means includes a spring loaded first guide member and a spring loaded second guide member received respectively in said longitudinal bores and a rolling piece received in said transverse bore, said first guide member engaging with said cam member of said actuating means, said second guide member engaging with said release plate, said rolling piece being in between said second end of said transverse bore and in contact with said first and second guide members to transmit a motion from one to the other when the suitcase is in the right position, said rolling piece rolling to said first end of said transverse bore to interrupt the motion from said first guide member to said second guide member when the suitcase is reversed.

6. A lock as claimed in claim 5, further comprising a combination lock mounted in said body of said guiding means adjacent to said second guide member, said combination lock including dial wheel assemblies and bolt means which can extend out of or retract into said body of said guiding means by the operation of said dial wheel assemblies, said bolt means disengaging said second guide member from said release plate when said combination lock is not in a proper combination.

7. A lock as claimed in claim 6, in which said second guide member has a dog member fulcrummed thereat, and a spring to urge one end of said dog member so that another end of said dog member engages with said release plate, wherein said bolt means of said combination lock causes said dog member to disengage from said release plate when said bolt means is in its extending position.

8. A lock as claimed in claim 1, in which said actuating member of said actuating means is a substantially cylindrical body having one end with a projection extending axially therefrom, wherein said cam member of said actuating means includes a rotary cylindrical stem co-axial with said cylindrical body, said cylindrical stem having an end portion with peripheral protrusions extending radially and axially to engage with said axial projection of said cylindrical actuating member, and another end portion with a circular cam head, said cam head having inclined camming teeth extending axially and annularly to cam said elongated guide means.

9. A lock as claimed in claim 8, wherein said cam member further includes a sleeve provided movably around said stem portion, and a spring member to bias said sleeve toward said cam head, said sleeve having axially and annularly extending inclined teeth meshing with said camming teeth of said cam head and a radial projection to engage with said elongated guide means, said camming teeth camming said sleeve to move axially upon rotation.

10. A lock as claimed in claim 9, wherein said actuating means further includes a press button pivoted in said bowed handle and having one end in contact with another end of said cylindrical actuating member opposite to said projection of said cylindrical actuating member, wherein, upon depression said press button pivots about an axis and pushes said cylindrical actuating member.

11. A lock as claimed in claim 10, in which said press button has a retractable protrusion, and said another end of said cylindrical actuating member has a recess to engage with said retractable protrusion for said press button in a depressed position by the engagement of said protrusion and said recess, wherein each of said peripheral protrusions of said rotary cam member has at one side an engagement surface to engage with said axial projection of said actuating member and at an opposite side a round surface to permit said projection to pass thereover.

* * * * *